US008262462B2

(12) United States Patent
Lai

(10) Patent No.: US 8,262,462 B2
(45) Date of Patent: Sep. 11, 2012

(54) SYSTEMS AND METHODS FOR FACILITATING PARTICIPATION IN CARD GAMES

(76) Inventor: Tung Kwong Lai, Kwai Chung (HK)

( * ) Notice: Subject to any disclaimer, the term of this patent is extended or adjusted under 35 U.S.C. 154(b) by 49 days.

(21) Appl. No.: 13/016,906

(22) Filed: Jan. 28, 2011

(65) Prior Publication Data

US 2011/0187052 A1 Aug. 4, 2011

Related U.S. Application Data

(60) Provisional application No. 61/299,500, filed on Jan. 29, 2010.

(51) Int. Cl.
*A63F 9/24* (2006.01)

(52) U.S. Cl. ..... 463/22; 463/11; 271/65

(58) Field of Classification Search ..... 463/11, 463/22; 271/65, 303; 221/171
See application file for complete search history.

(56) References Cited

U.S. PATENT DOCUMENTS

| | | | | |
|---|---|---|---|---|
| 4,715,595 | A | 12/1987 | Ishigaki | |
| 5,082,269 | A * | 1/1992 | Hirayama et al. | 271/65 |
| 5,397,133 | A * | 3/1995 | Penzias | 463/22 |
| 5,966,160 | A | 10/1999 | Nardone et al. | |
| 6,264,296 | B1 | 7/2001 | Klinefelter et al. | |
| 6,318,914 | B1 | 11/2001 | Cuo et al. | |
| 6,685,312 | B2 | 2/2004 | Klinefelter et al. | |
| 6,809,751 | B2 | 10/2004 | Haas et al. | |
| 7,063,013 | B2 | 6/2006 | Jones et al. | |
| 7,328,897 | B2 | 2/2008 | Bryant et al. | |
| 7,377,611 | B2 | 5/2008 | Shimoyama | |
| 7,562,877 | B1 | 7/2009 | Hess et al. | |
| 2003/0064767 | A1 | 4/2003 | Brown | |
| 2007/0218978 | A1 | 9/2007 | Toyoda | |
| 2007/0238506 | A1 | 10/2007 | Ruckle | |
| 2008/0194334 | A1 | 8/2008 | Kuok et al. | |
| 2009/0291762 | A1 * | 11/2009 | Walker | 463/42 |

FOREIGN PATENT DOCUMENTS

| | | | |
|---|---|---|---|
| CN | 1539116 | A | 10/2004 |
| CN | 101015741 | A | 8/2007 |

OTHER PUBLICATIONS

PCT Written Opinion of the International Searching Authority in Application No. PCT/IB2011/000286, mailed Jul. 14, 2011 (4 pgs.).
PCT International Search Report in Application No. PCT/IB2011/000286, mailed Jul. 14, 2011 (4 pgs.).

* cited by examiner

*Primary Examiner* — Corbett B Coburn
(74) *Attorney, Agent, or Firm* — Finnegan, Henderson, Farabow, Garrett & Dunner, LLP

(57) ABSTRACT

A gaming system for facilitating participation in a card game by a player located remotely from a dealer of the card game is disclosed. The gaming system may include a dealer system, which may include a scanner for capturing electronic information representing a remote playing card dealt by the dealer. Additionally, the dealer system may include a first communications module for transmitting the information to one or more player systems. The gaming system may also include a player system, which may include a second communications module for receiving the information. Additionally, the player system may include a printing mechanism for (i) printing the information to a face of a local playing card and (ii) outputting the printed local playing card to a flipping mechanism. The player system may also include a flipping mechanism for selectively dealing the printed local playing card to the player either face up or face down.

21 Claims, 9 Drawing Sheets

SYSTEMS AND METHODS FOR FACILITATING PARTICIPATION IN CARD GAMES

CROSS-REFERENCE TO RELATED APPLICATION

This application claims the benefit of U.S. Provisional Patent Application No. 61/299,500, filed Jan. 29, 2010, entitled "Remote Playing Cards Printer," which is hereby incorporated by reference in its entirety.

TECHNICAL FIELD

The present disclosure relates generally to systems and methods for facilitating participation in card games and, more particularly, to systems and methods for facilitating participation in card games by players that are located remotely from dealers of the card games.

BACKGROUND

Card games including, for example, poker, blackjack, and baccarat, have conventionally been played in person at tables around which a dealer and one or more players sit and/or stand. Recently, however, card games are also being played online by players located remotely from dealers and/or each other. In order to participate in these online card games, a player accesses, though a graphical user interface (GUI), a virtual table hosted by a gaming establishment. The GUI may display to the player virtual cards and/or other virtual objects, and allow the player to place bets, request cards, interact with other players, and/or otherwise participate in the online card games.

Some players enjoy online card games, but others find them unappealing because the online card games do not closely enough replicate the in-person gaming experience. For example, some players enjoy handling physical playing cards, but may be unable to do so using the GUIs of existing online card games. This may be particularly problematic for players wishing to sit at physical tables with other players. Although it may be advantageous for the players to keep their cards secret from each other, the players may be unable to do so if their cards are displayed on the GUIs.

The disclosed systems and methods are directed to overcoming one or more of the problems set forth above and/or other problems in the art.

SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

The present invention is related to a player system for facilitating participation in a card game by a player located remotely from a dealer of the card game. The player system may include a communications module for receiving electronic information representing a remote playing card. The information may include at least a rank and a suit of the remote playing card. The player system may also include a printing mechanism for (i) printing the information representing the remote playing card to a face of a local playing card and (ii) outputting the printed local playing card to a flipping mechanism. Additionally, the player system may include a flipping mechanism for selectively dealing the printed local playing card to the player either face up or face down.

The present invention is also related to a method of operating a player system for facilitating participation in a card game by a player located remotely from a dealer of the card game. The method may include displaying an image of the dealer dealing a remote playing card to the player. In addition, the method may include receiving electronic information representing the remote playing card. The information may include at least a rank and a suit of the remote playing card. The method may also include printing the information representing the remote playing card to a face of a local playing card. Additionally, the method may include selectively dealing the printed local playing card to the player either face up or face down.

In addition, the present invention is related to a networked gaming system for facilitating participation in a card game by a player located remotely from a dealer of the card game. The networked gaming system may include a dealer system. The dealer system may include a scanner for capturing electronic information representing a remote playing card dealt by the dealer. Additionally, the dealer system may include a first communications module for transmitting the information, via a communication network, to one or more player systems. The networked gaming system may also include a player system located remotely from the dealer system. The player system may include a second communications module for receiving, via the communication network, the information. Additionally, the player system may include a printing mechanism for (i) printing the information to a face of a local playing card and (ii) outputting the printed local playing card to a flipping mechanism. The player system may also include a flipping mechanism for selectively dealing the printed local playing card to the player either face up or face down.

Aside from the arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DETAILED DESCRIPTION

Figure 1:
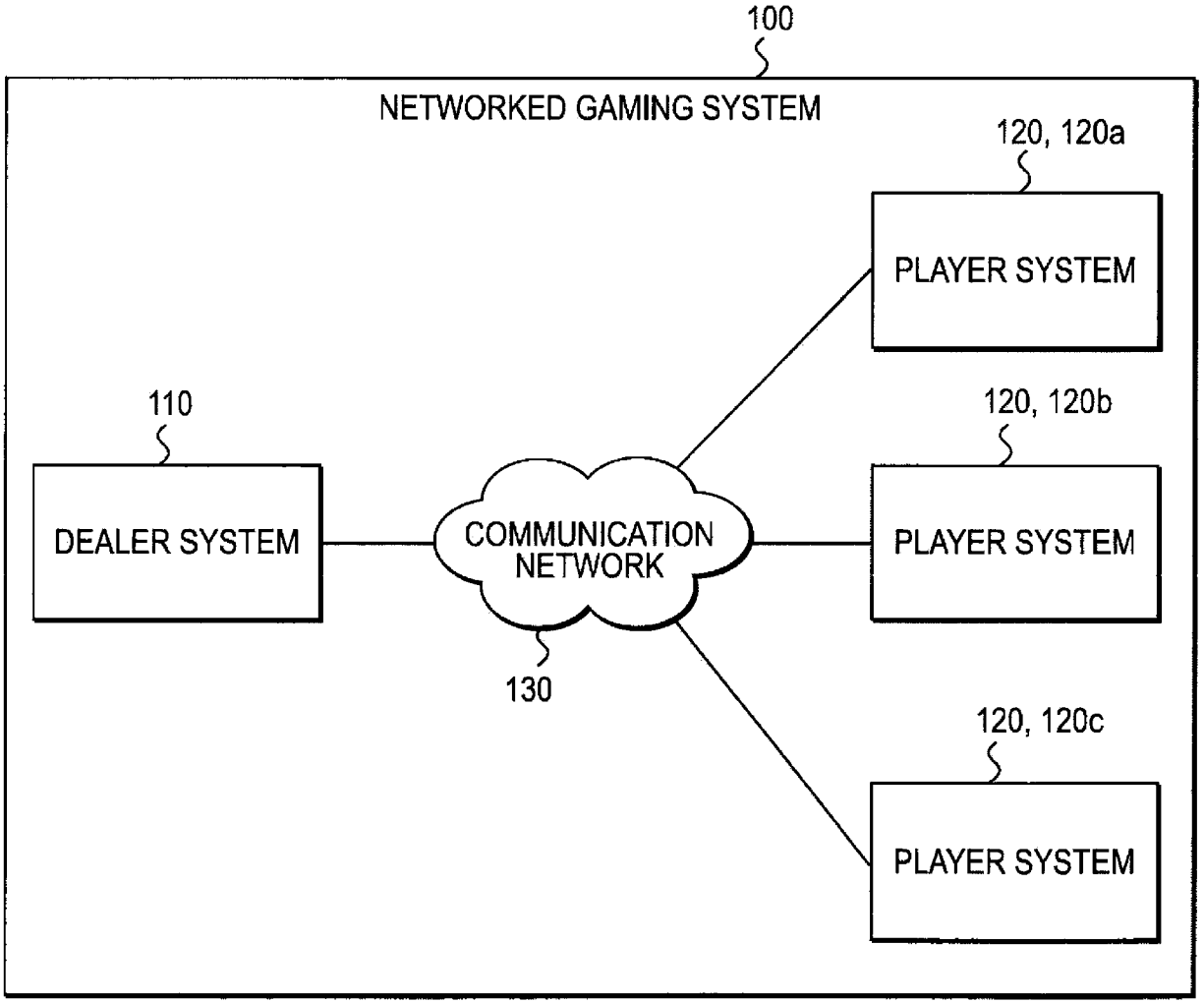
FIG. 1 is a diagrammatic illustration of an exemplary networked gaming system including an exemplary dealer system and several exemplary player systems.

Reference will now be made in detail to a few exemplary embodiments of the invention. Wherever possible, the same reference numbers are used in the drawings and the description to refer to the same or like parts.

As shown in FIG. 1, a networked gaming system 100 may include a dealer system 110, one or more player systems 120 (e.g., player systems 120*a*, 120*b*, and 120*c*), and a communication network 130. Dealer system 110 may be operated by a dealer of a card game, and player systems 120 may be operated by players of the card game. It is contemplated that dealer system 110 may be located at a gaming table in a gaming establishment, and player systems 120 may be located remotely from the gaming table. For example, player systems 120 may be located in a different room, a different building, and/or a different city than the gaming table. Although player systems 120 may be located near each other, it is contemplated that player systems 120 may also be located remotely from each other (e.g., player systems 120*a*, 120*b*, and/or 120*c* may be located in different rooms, buildings, and/or cities).

Communication network 130 may facilitate communication between dealer system 110 and player systems 120. Communication network 130 may include one or more network types, such as, for example, a wide-area network (WAN), a local-area network (LAN), or the Internet. Communication network 130 may be wired or wireless, and may use transmission control protocol/internet protocol ("TCP/IP") or any other appropriate protocol to facilitate communication between dealer system 110 and player systems 120. For example, network connections between dealer system 110 and player systems 120 may be established via Ethernet, telephone line, cellular channels, or other transmission media.

Figure 2:
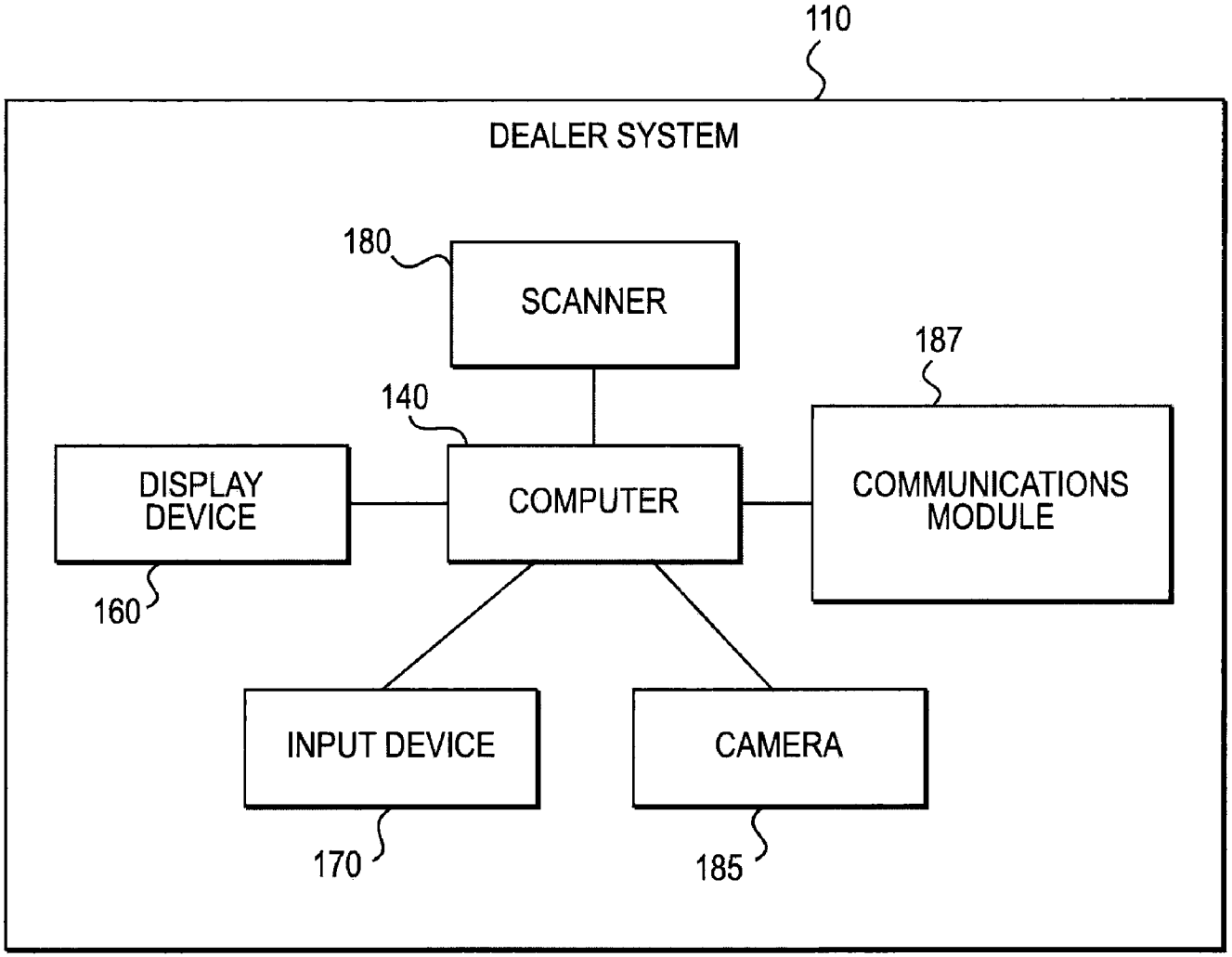
FIG. 2 is a diagrammatic illustration of the dealer system of FIG. 1.

As shown in FIG. 2, dealer system 110 may include a computer 140, which may include one or more processors (not shown) and one or more memory devices (not shown). Computer 140 may communicate with and/or control a display device 160, an input device 170, a scanner 180, a camera 185, and/or a communications module 187.

Computer 140 may communicate with and/or control display device 160 and/or input device 170 to interface with the dealer. In particular, computer 140 may cause display device 160 to display a GUI (not shown) to the dealer, and the dealer may use input device 170 to control, via the GUI, operation of computer 140. For example, display device 160 may be a liquid crystal display (LCD), an electroluminescent display (ELD), a cathode ray tube (CRT) monitor, or another type of display device, and user input device 170 may be a mouse, a keyboard, a microphone, a touch screen, or another type of input device.

Figure 3:
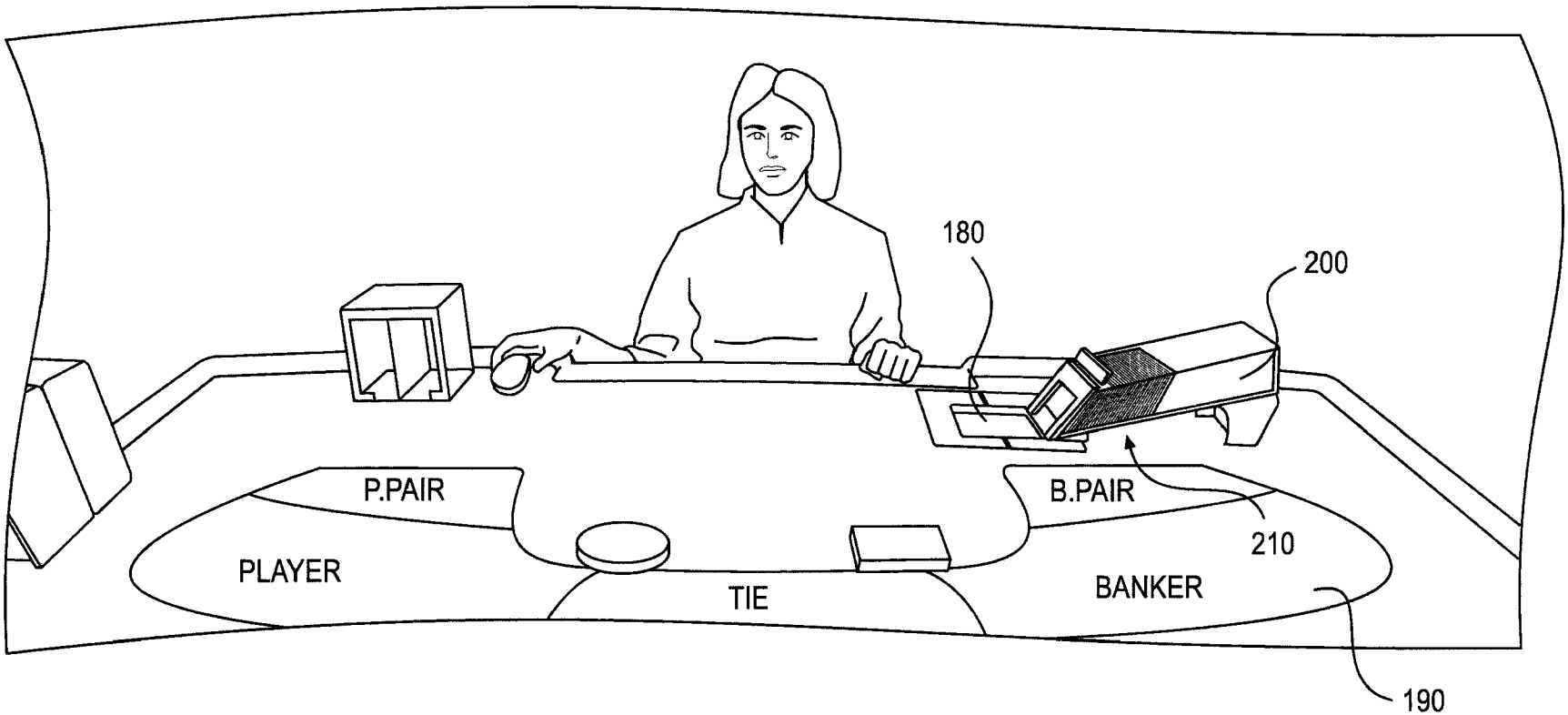
FIG. 3 is an exemplary image captured by an exemplary camera of the dealer system of FIG. 1.

Computer 140 may communicate with and/or control scanner 180 to determine information representing playing cards that the dealer deals during a card game. As shown in FIG. 3, for example, scanner 180 may be embedded in a gaming table 190 next to a shoe 200. Alternatively, scanner 180 may be embedded in shoe 200. In either case, it is contemplated that scanner 180 may capture and transmit to computer 140 electronic information representing playing cards 210 as they are removed from shoe 200. For example, scanner 180 may capture and transmit to computer 140 images of playing cards 210. Alternatively, scanner 180 may capture and transmit to computer 140 other electronic information representing playing cards 210. For example, in some embodiments, playing cards 210 may contain RFD chips, and scanner 180 may read and transmit to computer 140 electronic information stored on the RFID chips. In any case, it is contemplated that the electronic information may include or be indicative of the respective ranks and suits of playing cards 210.

Figure 4:
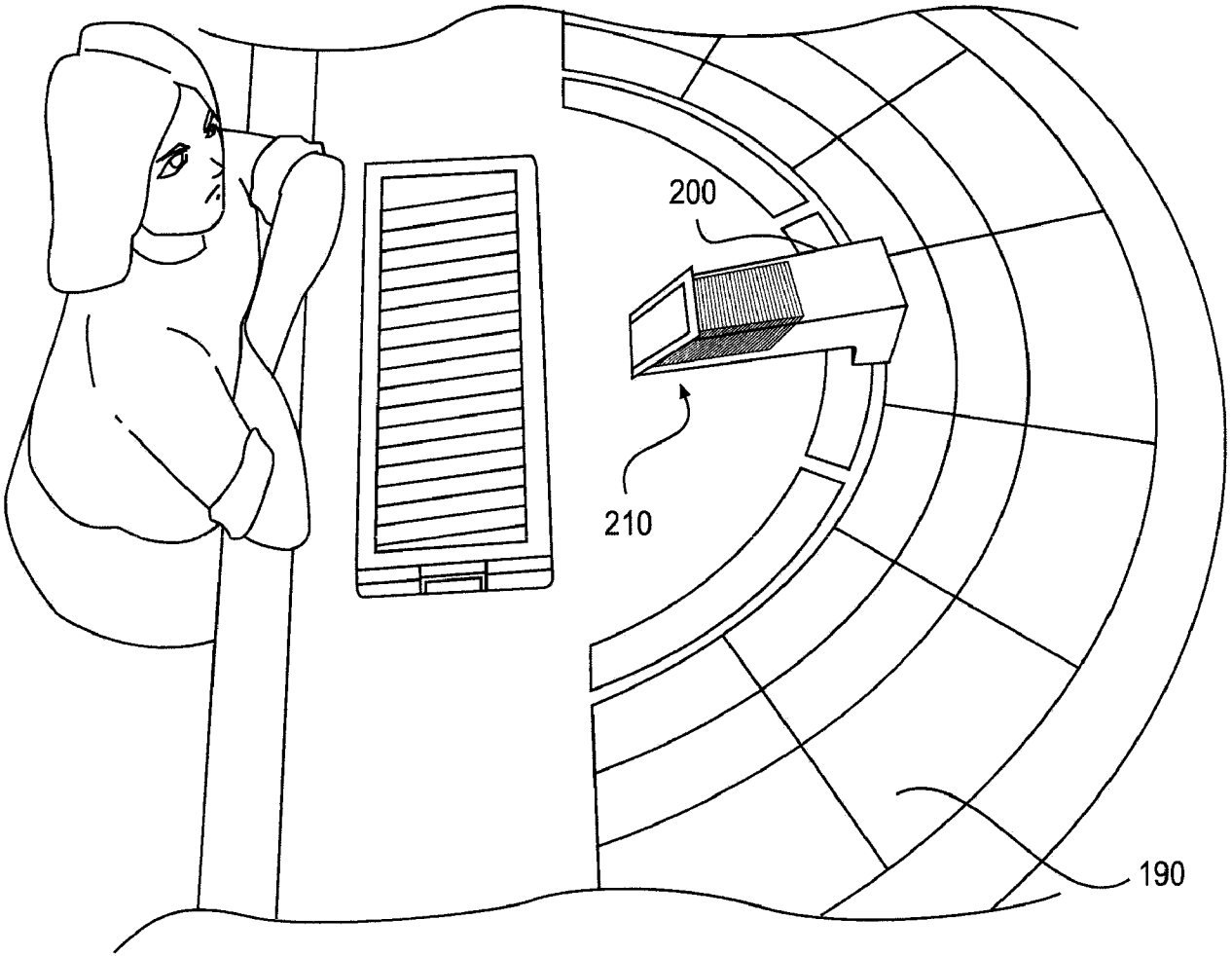
FIG. 4 is another exemplary image captured by another exemplary camera of the dealer system of FIG. 1.

Computer 140 may communicate with and/or control camera 185 to capture images of the dealer dealing playing cards 210. For example, these images may include head-on views (e.g., the view of FIG. 3) or birds-eye views (e.g., the view FIG. 4). As used herein, "head-on" views are views that a player would have if he/she was sitting at gaming table 190.

Computer 140 may communicate with and/or control communications module 187 (referring to FIG. 2) to interface with player systems 120 via communication network 130. For example, communications module 187 may include hardware and/or software that enables computer 140 to transmit electronic information to and/or receive electronic information from player systems 120 via communication network 130. For example, as discussed in further detail below, computer 140 may transmit to player systems 120 electronic information representing playing cards 210, electronic information indicating whether playing cards 210 are dealt face up or face down, and/or images of the dealer dealing playing cards 210. Additionally, computer 140 may receive from player systems 120 player requests and/or instructions.

Figure 5:
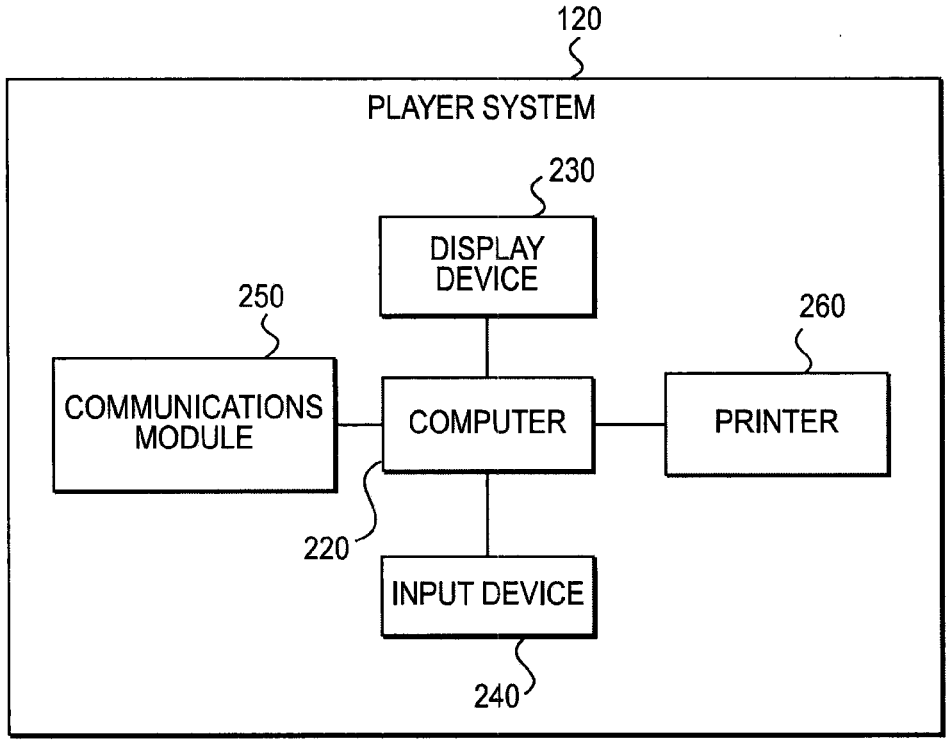
FIG. 5 is a diagrammatic illustration of one of the player systems of FIG. 1.

As shown in FIG. 5, each player system 120 (hereafter "player system 120") may include a computer 220, which may include one or more processors (not shown) and one or more memory devices (not shown). Computer 220 may communicate with and/or control a display device 230, an input device 240, a communications module 250, and/or a printer 260.

Computer 220 may communicate with and/or control display device 230 and/or input device 240 to interface with a player. In particular, computer 220 may cause display device 230 to display a GUI (not shown) to the player, and the player may use input device 240 to control, via the GUI, operation of computer 220. For example, display device 230 may be an LCD, an ELD, a CRT monitor, or another type of display device, and user input device 240 may be a mouse, a keyboard, a microphone, a touch screen, or another type of input device.

Computer 220 may communicate with and/or control communications module 250 to interface with dealer system 110 and/or other player systems 120 via communication network 130. For example, communications module 250 may include hardware and/or software that enables computer 220 to transmit electronic information to and/or receive electronic information from dealer system 110 and/or other player systems 120 via communication network 130. For example, as discussed in further detail below, computer 220 may receive from dealer system 110 electronic information representing playing cards 210, electronic information indicating whether playing cards 210 are dealt face up or face down, and/or images of the dealer dealing playing cards 210. Additionally, computer 220 may transmit to dealer system 110 player requests and/or instructions. Computer 220 also may, for example, transmit to and/or receive from dealer system 110 and/or other player systems 120 text, audio, and/or video communications. Such communications may enable the dealer and/or players operating player systems 120 to interact with each other.

Computer 220 may communicate with and/or control printer 260 to print information representing playing cards 210 dealt by the dealer (hereafter "remote playing cards 210") to faces 270 of local playing cards 280 (referring to FIGS.

8A-8E and 9), and to selectively deal local playing cards 280 to the player either face up or face down.

Figure 6:
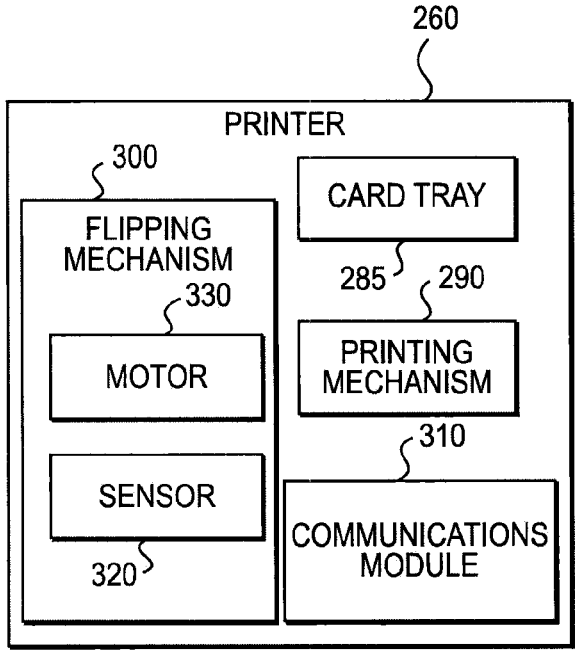
FIG. 6 is a diagrammatic illustration of an exemplary printer of the player system of FIG. 5.
Figure 7:
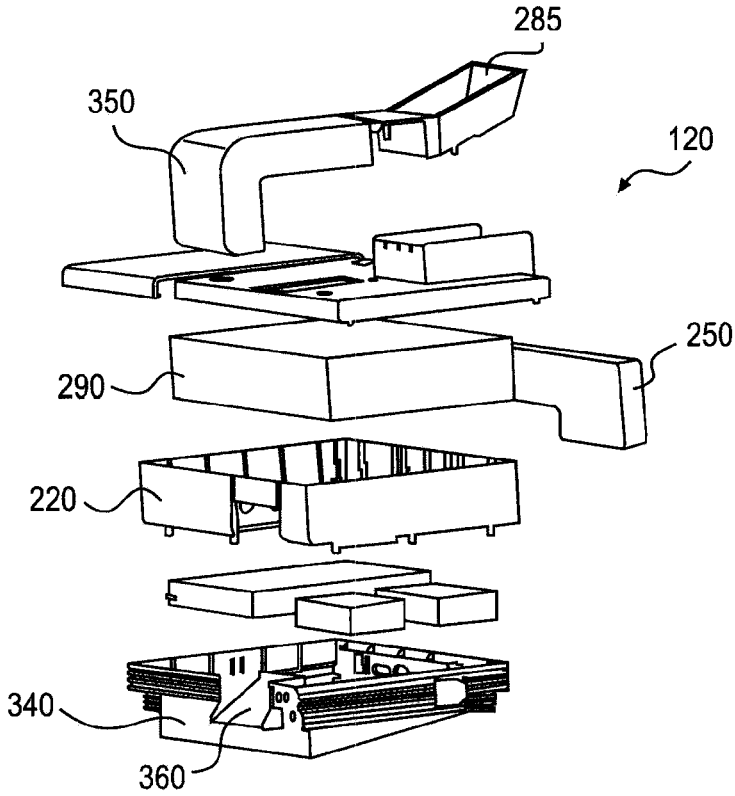
FIG. 7 is an exploded view of one of the player systems of FIG. 1.

As shown in FIG. 6, printer 260, which may or may not be housed in a single integrated unit with computer 220, may include a card tray 285, a printing mechanism 290, and a flipping mechanism 300. In some embodiments, printer 260 may also include a communications module 310. For example, printer 260 may include communications module 310 when printer 260 and computer 220 are separately housed. In such embodiments, components of printer 260 (e.g., printing mechanism 290 and flipping mechanism 300) may communicate with computer 220 via communications module 310. For example, communications module 310 may include hardware and/or software that enables the components of printer 260 to wirelessly or wiredly transmit electronic information to and/or receive electronic information from computer 220.

Regardless of whether printer 260 and computer 220 are housed in a single integrated unit, card tray 285 may be used to store blank-faced local playing cards 280. Printing mechanism 290 may receive local playing cards 280 from card tray 285, and may print information representing remote playing cards 210 to faces 270 of local playing cards 280. This information may include the respective ranks and suits of remote playing cards 210. For example, printing mechanism 290 may include a toner-based printing mechanism, a liquid inkjet printing mechanism, a solid ink printing mechanism, a thermal printing mechanism, a dot-matrix printing mechanism, or another type of printing mechanism. After printing the information to faces 270 of local playing cards 280, printing mechanism 290 may output local playing cards 280 to flipping mechanism 300.

Flipping mechanism 300 may selectively deal local playing cards 280 to the player either face up or face down. Therefore, it is contemplated that flipping mechanism 300 may operate in one of two different configurations (a first configuration in which flipping mechanism 300 deals local playing cards 280 face up, and a second configuration in which flipping mechanism 300 deals local playing cards 280 face down). For example, in a blackjack game, playing cards are dealt face up, so flipping mechanism 300 would be operated in the first configuration. In contrast, in a poker game, playing cards are dealt face down, so flipping mechanism 300 would be operated in the second configuration.

Flipping mechanism 300 may include a sensor 320 and/or a motor 330 for ensuring that flipping mechanism 300 is operated in the appropriate configuration for a given card game. For example, computer 220 may, based on electronic information received from dealer system 110, use sensor 320 to determine whether flipping mechanism 300 is appropriately configured for a card game currently being played. If flipping mechanism 300 is not appropriately configured, computer 220 may control display device 230 to instruct the player to alter the configuration of flipping mechanism 300. Alternatively, computer 220 may operate motor 330 to alter the configuration of flipping mechanism 300.

For example, as shown in FIGS. 7, 8A-8E, and 9, flipping mechanism 300 may also include surfaces of a cabinet 340 of player system 120 and a door 350 of player system 120. Specifically, flipping mechanism 300 may include exterior surface 360 of cabinet 340 and interior surface 370 of door 350. Cabinet 340 may be fixedly positioned relative to printing mechanism 290, and door 350 may be moveable between an open position (referring to FIG. 9) and a closed position (referring to FIGS. 7 and 8A-8E). In such an embodiment, it is contemplated that flipping mechanism 300 may deal local playing cards 280 face up when door 350 is in the open position, and may deal local playing cards 280 face down when door 350 is in the closed position. Thus, computer 220 may, based on electronic information received from dealer system 110, use sensor 320 to determine whether door 350 is appropriately positioned for a card game currently being played. If door 350 is not appropriately positioned, computer 220 may control display device 230 to instruct the player to open or close door 350. Alternatively, computer 220 may operate motor 330 to open or close door 350.

Figure 8A:
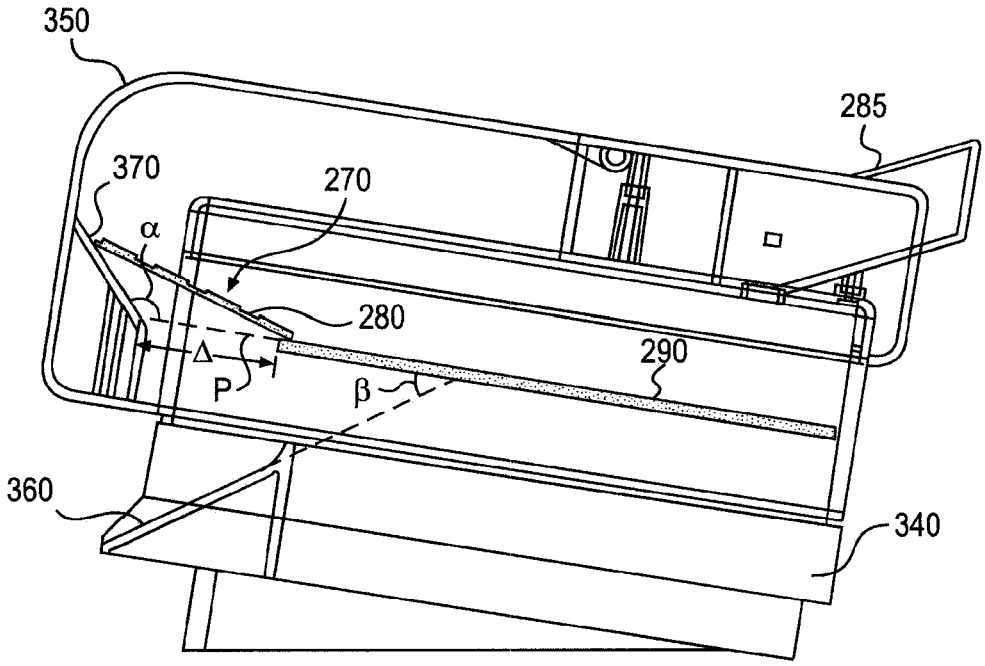
FIGS. 8A-8E are cross-sectional views of the player system of FIG. 7 dealing an exemplary playing card face up.
Figure 8B:
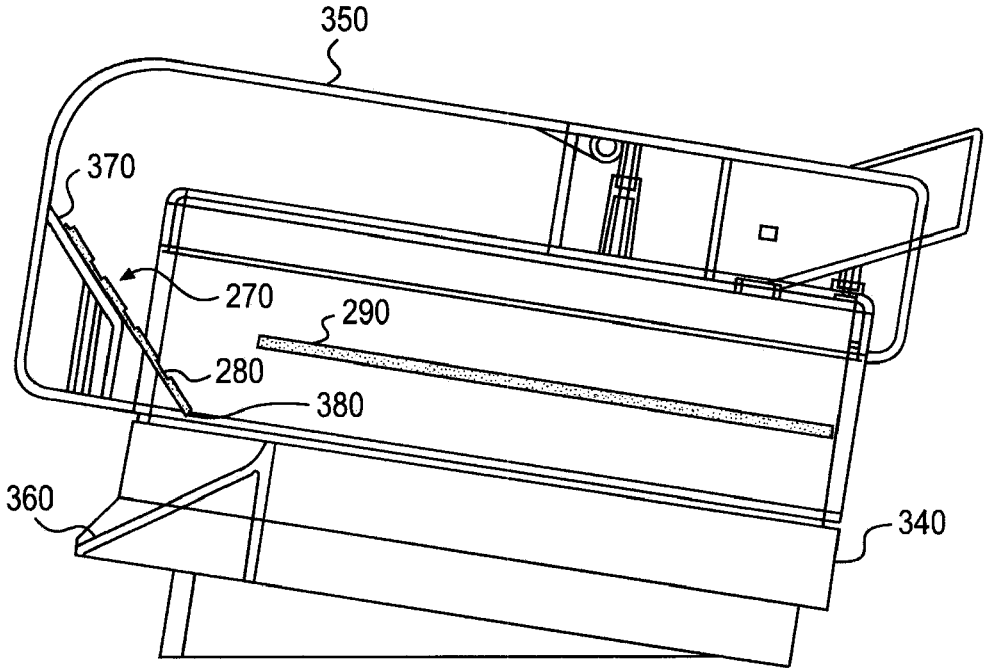
Figure 8C:
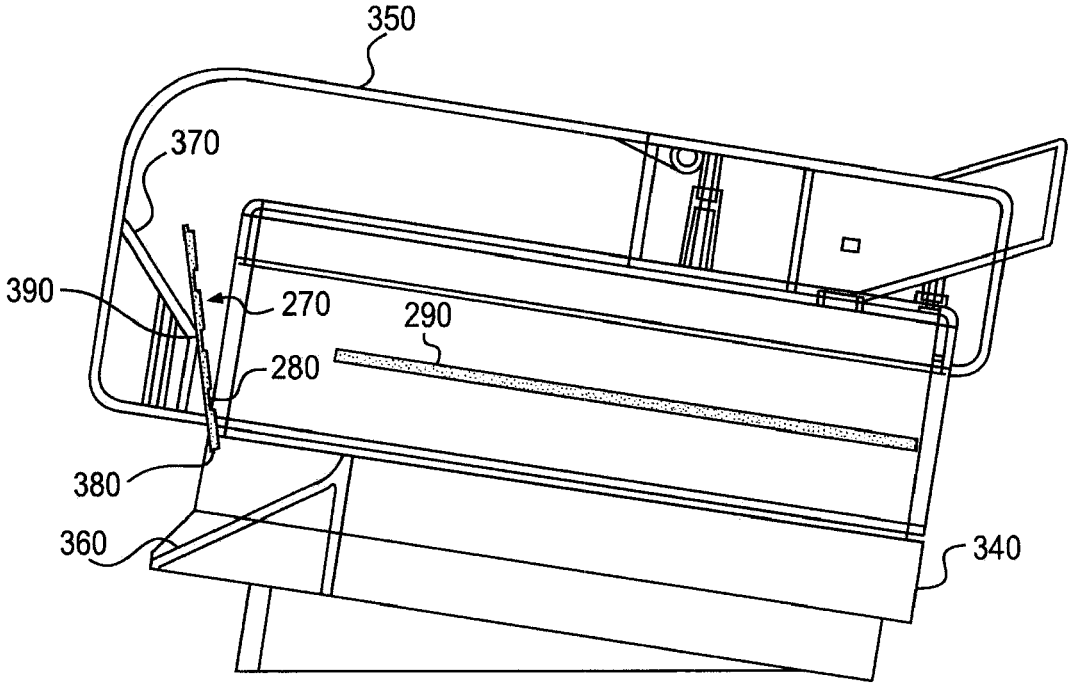
Figure 8D:
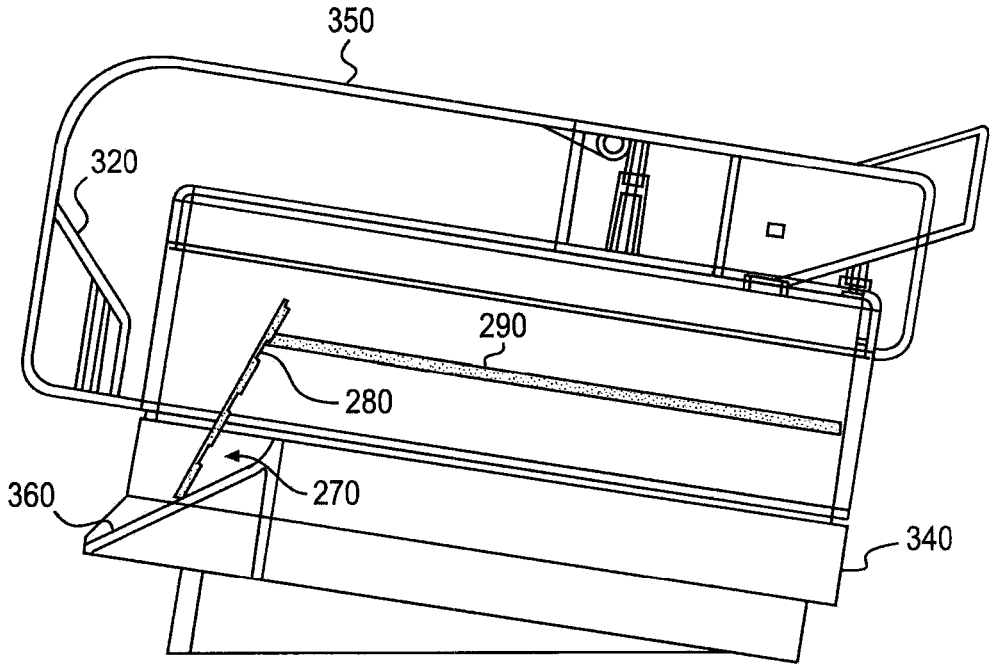
Figure 8E:
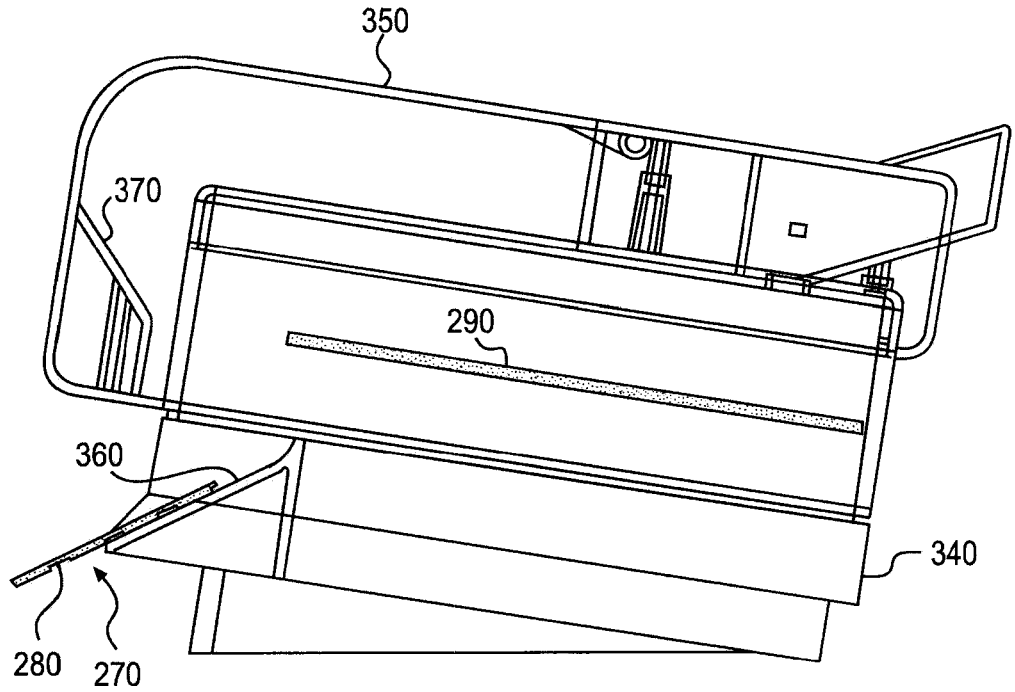

As shown in FIG. 8A, when door 350 is in the closed position, interior surface 370 may be inclined at an angle $\alpha$ relative to a printing plane P along which local playing cards 280 are output by printing mechanism 290, and may intersect with printing plane P at a distance $\Delta$ from printing mechanism 290. Exterior surface 360 may be inclined at an angle 13 relative to printing plane P, and may be positioned below printing plane P when player system 110 is in use. It is contemplated that angle $\alpha$, angle $\beta$, and distance $\Delta$ may vary based on a size of local playing cards 280. For example, playing cards 280 may be approximately 63 mm by approximately 88 mm. In embodiments adapted for such local playing cards 280, angle $\alpha$ may be between approximately 122.5 degrees and approximately 152.5 degrees; angle $\beta$ may be between approximately 19.5 degrees and approximately 49.5 degrees; and distance $\Delta$ may be between approximately 37 mm and approximately 41 mm. For example, angle $\alpha$ may be approximately 137.5 degrees; angle $\beta$ may be approximately 34.5 degrees; and distance $\Delta$ may be approximately 39 mm.

As discussed above, when door 350 is in the closed position, local playing cards 280 may be dealt face down. For example, printing mechanism 290 may output a local playing card 280 face up along printing plane P toward interior surface 370 of door 350. As playing card 280 contacts interior surface 370, playing card 280 may be deflected upward from printing plane P (referring to FIG. 8A). Once playing card 280 is completely output by printing mechanism 290 (i.e., once playing card 280 is no longer supported by printing mechanism 290), a rear edge 380 of playing card 280 may fall toward exterior surface 360 of cabinet 340, allowing playing card 280 to momentarily contact only interior surface 370 (referring to FIG. 8B). Rear edge 380 of playing card 280 may then continue falling toward exterior surface 360, while playing card 280 pivots about an innermost edge 390 of interior surface 370 (referring to FIG. 8C). Eventually, rear edge 380 of playing card 280 may land on exterior surface 360, and, as a result of playing card 280's pivoting, face 270 of playing card 280 may hit printing mechanism 290 (referring to FIG. 8D). Playing card 280 may then slide face down off of exterior surface 360 to the player (referring to FIG. 8E).

Figure 9:
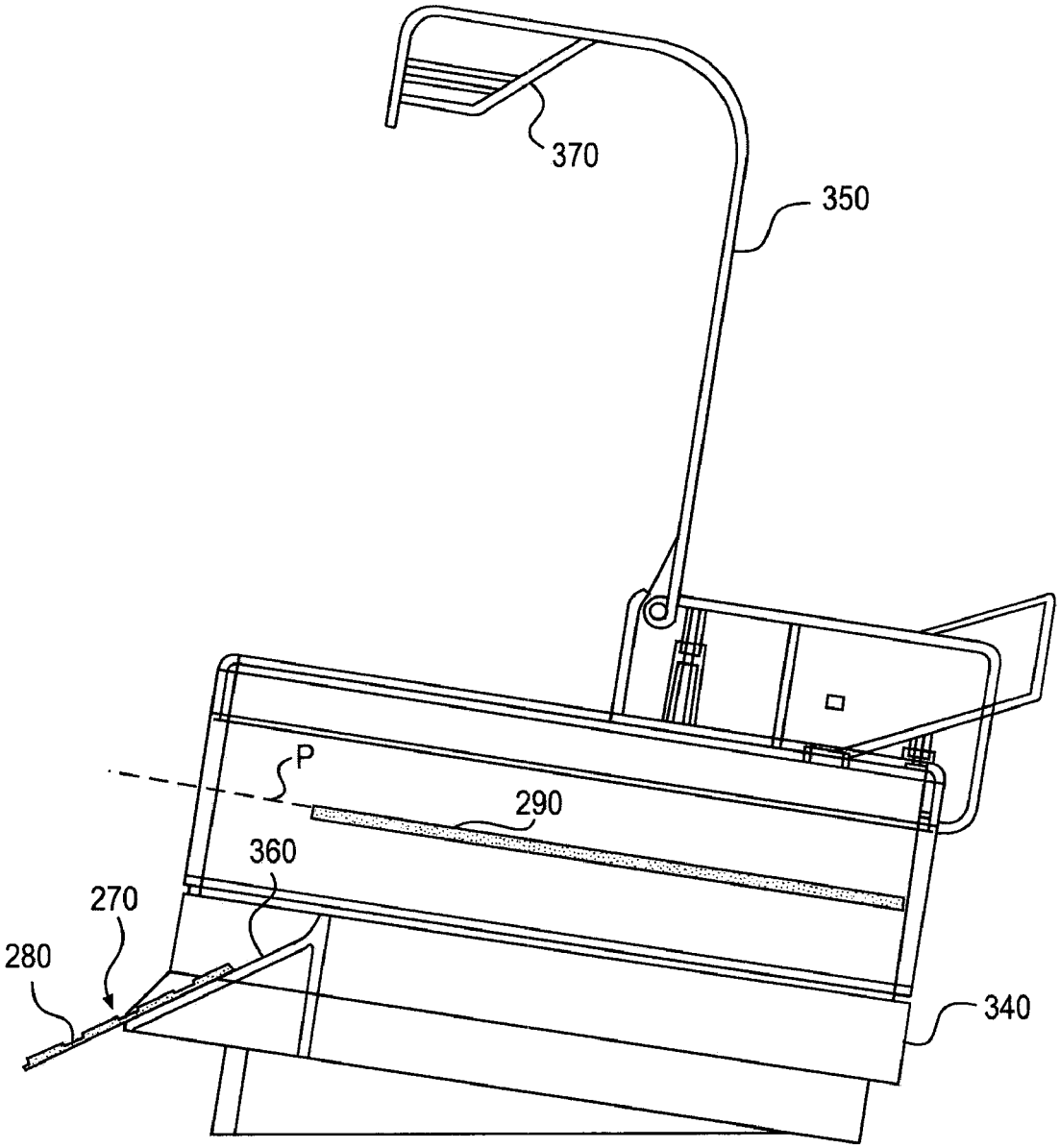
FIG. 9 is a cross-sectional view of the player system of FIG. 7 dealing an exemplary playing card face down.

As also discussed above, when door 350 is in the open position, local playing cards 280 may be dealt face up. Similar to when door 350 is in the closed position, printing mechanism 290 may output a local playing card 280 face up along printing plane P. However, unlike when door 350 is in the closed position, playing card 280 will not be deflected upward. Therefore, as shown in FIG. 9, playing card 280 will fall directly toward exterior surface 360, landing on exterior surface 360, and then sliding face up off of exterior surface 360 to the player.

Exemplary methods of operating dealer systems 110 and player systems 120 to facilitate participation in card games by players that are located remotely from dealers of the card games will now be described. Although only one dealer system 110 is described above, it should be understood that a single gaming establishment may have dealer systems 110 located at multiple gaming tables, and that players could use player systems 120 to participate in card games at any of the gaming tables. For example, a player could use his/her player system 120 to access a website hosted by a gaming establishment. It is contemplated that the website might include a list of gaming tables outfitted with dealer systems 110, and that the player could choose to participate in card games at any of the listed gaming tables. For example, the player might choose to participate in a card game having certain betting limits, a certain dealer, certain players, and/or for another reason. It should be noted that the players of a given card game may include both players that are physically located at a gaming table with the dealer of the card game (hereafter "local players") and players using player systems 120 to remotely participate in the card game (hereafter "remote players").

Once a remote player chooses to participate in a particular card game, a dealer of the card game may be alerted to the presence of the remote player by a GUI displayed on display device 160 of dealer system 110. The dealer may then deal the remote player into the card game. In other words, the dealer may use dealer system 110 to interact with the remote player as if the remote player was a local player. For example, the dealer may, via input device 170, scanner 180, and/or camera 185, speak to, gesture to, deal cards to, manage bets of, and/or otherwise interact with the remote player. Additionally, the local players may, via input device 170 and/or camera 185, speak to, gesture to, place bets against, and/or otherwise interact with the remote player. Although interactions between the dealer, local players, and remote players may be via components of networked gaming system 100, it should be understood that the interactions may also be via telephone. For example, it is contemplated that, for security or other reasons, bets may be placed via telephone instead of via networked gaming system 100.

In any case, it is contemplated that, as the dealer deals remote playing cards 210 to the players, the dealer may slide remote playing cards 210 over scanner 180, allowing scanner 180 to capture electronic information representing remote playing cards 210. This information may include or be indicative of the respective ranks and suits of playing cards 210. Computer 140 may then use communications module 187 to transmit the information to player system 120. Although computer 140 may transmit the information to player system 120 directly, it is contemplated that computer 140 may alter the information before transmitting it to player system 120. For example, computer 140 may analyze the information to determine the respective ranks and suits of playing cards 210, and only transmit the respective ranks and suits to player system 120. Alternatively or additionally, computer 140 may add an indication of whether playing cards 120 should be dealt face down or face up to the information before transmitting it to player system 120. For example, the dealer may, using input device 170, specify to computer 140 whether playing cards 210 are dealt face down or face up. Alternatively, computer 140 may determine whether playing cards 210 are dealt face down or face up by analyzing images captured by camera 185.

While participating in the card game, the remote player may use player system 120 to interact with the dealer, local players, and/or other remote players. For example, the remote player may interact with the dealer, local players, and/or other remote players using input device 240 of player system 120 and a GUI displayed on display device 230 of player system 120. It is contemplated that the GUI may display to the player images captured by camera 185 (e.g., images of the dealer dealing remote playing cards 210 to the remote player and/or other players), and may allow the remote player to place bets and/or otherwise interact with the dealer, local players, and/or other remote players.

Additionally, the remote player may interact with the dealer using printer 260. As discussed above, computer 140 may transmit to player system 120 electronic information representing remote playing cards 210. Printer 260 may receive this information via computer 220, and may print it to faces 270 of local playing cards 280. Printer 260 may then selectively deal local playing cards 280 to the remote player either face up or face down. For example, as discussed above with reference to FIGS. 8A-8E and 9, playing cards 280 may be dealt to the remote player face down if door 350 is closed, and may be dealt to the remote player face up if door 350 is open. Thus, it is contemplated that, before printer 260 prints the information to faces 270 of local playing cards 280, computer 220 may, based on the electronic information received from dealer system 110, use sensor 320 to determine whether door 350 is appropriately positioned to correctly deal local cards 280 face up or face down. If door 350 is not appropriately positioned, computer 220 may control display device 230 to instruct the remote player to open or close door 350. Alternatively, computer 220 may operate motor 330 to open or close door 350. Printer 260 may then print the information representing remote playing cards 210 to faces 270 of local playing cards 280, and correctly deal local cards 280 to the player either face up or face down.

It is contemplated that, by displaying images of the dealer dealing remote playing cards 210 to the player, and by selectively dealing local playing cards 280 having the same respective suits and ranks as remote playing cards 210 to the player either face up or face down, networked gaming system 100 may closely replicate for remote the player the gaming experience of local players. Since the remote player will be able to handle local playing cards 280, there will be no need to display the player's cards on the GUI of display device 230. Thus, it may be possible for multiple remote players to sit in the same room and participate in a single card game taking place at a remote location. Accordingly, it is contemplated that networked gaming system 100 may facilitate participation in card games by players that are located remotely from dealers of the card games.

The embodiments and aspects of the invention described above are not restrictive of the invention as claimed. Other embodiments consistent with the above-discussed features and principles are included in the scope of the present invention. For example, it is contemplated that the processes carried out by computers 140 and 220 may be otherwise distributed between computers 140 and 220. Additionally, it is contemplated that some or all of the processes carried out by computers 140 and 220 may instead be carried out by other computers such as, for example, computers that are components of communication network 130 and/or computers that are internal to other components of dealer system 110 and/or player system 120.

In the foregoing description, various features are grouped together for purposes of streamlining the disclosure. This method of disclosure is not to be interpreted as reflecting an intention that the claimed invention requires more features than are expressly recited in each claim. Rather, as the following claims reflect, inventive aspects may relate to fewer than all features of any particular embodiment disclosed herein.

What is claimed is:

1. A player system for facilitating participation in a card game by a player located remotely from a dealer of the card game, comprising:

a communications module for receiving electronic information representing a remote playing card, the information comprising at least a rank and a suit of the remote playing card;

a printing mechanism for:

printing the information representing the remote playing card to a face of a local playing card, and outputting the printed local playing card to a flipping mechanism;

a flipping mechanism for selectively dealing the printed local playing card to the player either face up or face down; and a door moveable between an open position and a closed position, wherein:

the flipping mechanism includes an interior surface of the door;

when the door is in the closed position, the flipping mechanism deals the printed local playing card to the player face down; and when the door is in the open position, the flipping mechanism deals the printed local playing card to the player face up.

2. The player system of claim 1, wherein, when the door is in the closed position, the interior surface is inclined at an angle $\alpha$ relative to a printing plane along which the printed local playing card is output by the printing mechanism, and intersects with the printing plane.

3. The player system of claim 2, wherein the angle $\alpha$ is between approximately 122.5 degrees and approximately 152.5 degrees.

4. The player system of claim 3, wherein the angle $\alpha$ is approximately 137.5 degrees.

5. The player system of claim 2, wherein, when the door is in the closed position, a distance $\Delta$ from the printing mechanism to the interior surface along the printing plane is between approximately 37 mm and approximately 41 mm.

6. The player system of claim 5, wherein the distance $\Delta$ is approximately 39 mm.

7. The player system of claim 2, further including a cabinet, wherein:

the flipping mechanism includes an exterior surface of the cabinet;

the exterior surface of the cabinet is inclined at an angle $\beta$ relative to the printing plane; and when the player system is in use, the exterior surface is positioned below the printing plane.

8. The player system of claim 7, wherein the angle $\beta$ is between approximately 19.5 degrees and approximately 49.5 degrees.

9. The player system of claim 8, wherein the angle $\beta$ is approximately 34.5 degrees.

10. The player system of claim 1, further including:

a motor for opening or closing the door; and a computer in communication with the motor and the communications module, wherein:

the information received by the communications module also includes an electronic indication as to whether the printed local playing card should be dealt face down or face up; and the computer operates the motor to open or close the door based on the indication.

11. The player system of claim 1, further including:

a sensor for sensing whether the door is open or closed;

a display device; and a computer in communication with the sensor, the display device, and the communications module, wherein:

the information received by the communications module also includes an electronic indication as to whether the printed local playing card should be dealt face down or face up; and based on the sensing and the indication, the computer controls the display device to instruct the player to open or close the door.

12. The player system of claim 1, further including a card tray for storing at least one blank-faced local playing card, wherein the printing mechanism receives the at least one blank-faced local playing card from the card tray.

13. A method of operating a player system for facilitating participation in a card game by a player located remotely from a dealer of the card game, comprising:

displaying an image of the dealer dealing a remote playing card to the player;

receiving electronic information representing the remote playing card, the information comprising at least a rank and a suit of the remote playing card;

printing the information representing the remote playing card to a face of a local playing card; and selectively dealing the printed local playing card to the player either face up or face down, wherein dealing the printed local playing card to the player face down includes outputting the printed local playing card from a printing mechanism along a printing plane, and wherein, when a door of the player system is in a closed position:

an interior surface of the door is inclined relative to the printing plane;

the interior surface intersects with the printing plane;

the printed local playing card is output toward the interior surface; and the printed local playing card is dealt to the player face down.

14. The method of claim 13, wherein, when the door is in an open position:

the interior surface does not intersect with the printing plane; and the printed local playing card is dealt to the player face up.

15. The method of claim 14, wherein:

the information includes an indication as to whether the printed local playing card should be dealt face down or face up; and before printing the information representing the remote playing card to the face of the local playing card, the door is opened or closed based on the indication.

16. The method of claim 15, further including operating a motor to open or close the door.

17. The method of claim 13, wherein the image of the dealer includes a head-on view of the dealer.

18. The method of claim 13, wherein the image of the dealer includes a birds-eye view of the dealer.

19. The method of claim 13, wherein the information is received, via a communication network, from a dealer system operated by the dealer.

20. The method of claim 19, wherein the information includes an image of the remote playing card captured by a scanner of the dealer system.

21. A networked gaming system for facilitating participation in a card game by a player located remotely from a dealer of the card game, the networked gaming system comprising:

a dealer system comprising:

a scanner for capturing electronic information representing a remote playing card dealt by the dealer; and a first communications module for transmitting the information, via a communication network, to one or more player systems; and a player system located remotely from the dealer system, the player system comprising:

a second communications module for receiving, via the communication network, the information;

a printing mechanism for:

printing the information to a face of a local playing card, and outputting the printed local playing card to a flipping mechanism;

a flipping mechanism for selectively dealing the printed local playing card to the player either face up or face down; and a door moveable between an open position and a closed position, wherein:

the flipping mechanism includes an interior surface of the door;

when the door is in the closed position, the flipping mechanism deals the printed local playing card to the player face down; and when the door is in the open position, the flipping mechanism deals the printed local playing card to the player face up.

* * * * *